US005494063A

United States Patent [19]

Suzuki et al.

[11] Patent Number: 5,494,063

[45] Date of Patent: Feb. 27, 1996

[54] ULTRASONIC DEGREASING APPARATUS

[75] Inventors: Katsunori Suzuki; Yoshiaki Ishikawa; Noriaki Suzuki; Mitsutaka Suzuki, all of Iwate, Japan

[73] Assignee: NEC Corporation, Japan

[21] Appl. No.: 408,689

[22] Filed: Mar. 21, 1995

[30] Foreign Application Priority Data

Mar. 30, 1994 [JP] Japan ..... 6-060465

[51] Int. Cl.[6] ..... B08B 3/10

[52] U.S. Cl. ..... 134/61; 134/76; 134/184; 134/108; 134/107; 134/902

[58] Field of Search ..... 134/61, 76, 184, 134/102.3, 138, 135, 144, 105, 107, 902, 108

[56] References Cited

U.S. PATENT DOCUMENTS

| | | | |
|---|---|---|---|
| 2,036,261 | 4/1936 | Dinley | 134/76 |
| 3,151,620 | 10/1964 | Kellard | 134/76 |
| 4,753,255 | 6/1988 | Melin | 134/76 |
| 4,886,082 | 12/1989 | Kato et al. | 134/107 |
| 4,895,176 | 1/1990 | Ohtsuka et al. | 134/107 |
| 5,067,983 | 11/1991 | Uchino | 134/184 |
| 5,345,958 | 9/1994 | Otsuka | 134/105 |
| 5,361,789 | 11/1994 | Yoshida et al. | 134/76 |
| 5,402,806 | 4/1995 | Nakeem et al. | 134/108 |

FOREIGN PATENT DOCUMENTS

| | | |
|---|---|---|
| 58-108568 | 6/1983 | Japan . |
| 59-74300 | 4/1984 | Japan . |
| 61-103477 | 7/1986 | Japan . |
| 63-221878 | 9/1988 | Japan . |
| 64-27680 | 1/1989 | Japan . |
| 64-30686 | 2/1989 | Japan . |
| 1-100300 | 4/1989 | Japan . |
| 1-123683 | 5/1989 | Japan . |
| 3-79792 | 4/1991 | Japan . |
| 4-32122 | 2/1992 | Japan . |
| 4-207030 | 7/1992 | Japan . |

*Primary Examiner*—Frankie L. Stinson
*Attorney, Agent, or Firm*—Ostrolenk, Faber, Gerb & Soffen

[57] ABSTRACT

An ultrasonic degreasing apparatus includes a cleaning section, a rinsing section, a hot water cleaning section, and a drying section. The cleaning section has an ultrasonic oscillator for oscillating ultrasonic waves in distilled water and a heater for heating the water, and performs a degreasing process including a cleaning process with respect to an object to be processed in the heated water by using ultrasonic waves. The cleaning section has a deaerating section for performing deaeration by circulating the distilled water. The rinsing section has an ultrasonic oscillator for oscillating ultrasonic waves in distilled water containing a rust preventive and a heater for heating the water, and performs a degreasing process including a rinsing process with respect to the object in the heated water by using the ultrasonic waves. The rinsing section has a deaerating section for performing deaeration by circulating the distilled water. The hot-water cleaning section has a heater arranged in distilled water, and performs a cleaning process with hot water with respect to the object in the distilled water heated by the heater. The drying section dries the cleaned object conveyed from the hot-water cleaning section.

12 Claims, 11 Drawing Sheets

ULTRASONIC DEGREASING APPARATUS

BACKGROUND OF THE INVENTION

The present invention relates to a degreasing apparatus and, more particularly, to an ultrasonic degreasing apparatus for degreasing parts for an electronic device and the like by using ultrasonic waves.

With the recent tendency to the total abolition of Freon and 1,1,1-trichloroethane which destroy the ozone layer, alternative methods and substitutes have been developed rapidly. Recently, in cleaning apparatuses, the use of degreasing methods using ultrasonic waves has increasingly been popularized. In these methods and similar methods, the following techniques have been proposed:

(1) techniques associated with plating apparatuses, in which objects to be processed are stored in a porous barrel and dipped in plating solutions (degreasing, pickling, plating, and cleaning solutions), and the barrel is rotated, with an ultrasonic oscillator being arranged in the apparatus, and more specifically, a technique associated with a plating apparatus, in which objects to be plated are stored in a porous barrel and is dipped in a plating solution together with the barrel, and ultrasonic waves from an ultrasonic oscillator are applied to the objects while the barrel is rotated, thereby efficiently plating the objects, as disclosed in Japanese Utility Model Laid-Open No. 61-103477, a technique of loading a barrel containing objects to be plated into a plating bath, and vibrating the plating bath with ultrasonic waves, as disclosed in Japanese Patent Laid-Open No. 59-74300, and a method of cleaning the aluminum tube of a photosensitive drum with an organic solvent, which method is designed to uniformly clean the entire surface of the aluminum tube by operating an ultrasonic oscillator while rotating the tube, as disclosed in Japanese Patent Laid-Open No. 58-108568;

(2) techniques without ultrasonic oscillators, such as a technique using mechanisms for raising/lowering and conveying a barrel and supplying a cleaning solution and a technique of cleaning objects to be processed by swinging the objects in a cleaning bath, and more specifically, a technique of cleaning plated objects in a barrel with water from a spray port together with the barrel, and cleaning a residual plating solution from the barrel and the objects, as disclosed in Japanese Patent Laid-Open No. 1-100300, a technique of cleaning a barrel containing objects in a degreasing bath and a pickling bath (in this technique, the barrel is rotated in each bath to allow efficient cleaning, and plating and cleaning operations are performed afterward), as disclosed in Japanese Patent Laid-Open No. 3-79792, and a technique associated with an apparatus for cleaning a shadow mask, in which an ultrasonic vibrator is arranged in a cleaning bath, together with a means for swinging the shadow mask in the cleaning bath, and the shadow mask is cleaned while the distance to the ultrasonic vibrator is changed, thereby uniformly cleaning the shadow mask; and (3) techniques of performing a cleaning operation upon improving the cleaning efficiency of ultrasonic waves by deaeration (Japanese Patent Laid-Open Nos. 63-221878, 1-27680, 1-30686, 1-123683, and 4-207030).

Furthermore, with regards to hydro-extraction of process solutions, the following techniques have been proposed:

(4) a method of decreasing the amount of process solution carried away while objects to be processed are conveyed between solution baths (Japanese Patent Laid-Open No. 1-100300); and (5) a method of performing sufficient hydro-extraction by holding a barrel, taken out from a process solution, above a bath for a long period of time according to a conveyance program.

Note that both methods (4) and (5) are designed to process objects which are easily deformed.

In the above conventional techniques, the types of process solutions are not limited, and process solutions suitable for the respective processes are used. As a factor indispensable for the alternative cleaning (degreasing) method described above, the use of water as a process solution is conceivable.

A conventional degreasing apparatus using water as a process solution will be described below with reference to FIG. 11. First of all, objects 1402 to be processed are stored in a barrel 1401 made of a porous wire mesh in the form of a hollow hexagonal column. The barrel 1401 is then loaded into a cleaning section 1403 filled with distilled water. The cleaning section 1403 is deaerated in advance by a first deaerating section 1409 using a vacuum pump 1411. The distilled water is circulating between the cleaning section 1403 and the first deaerating section 1409. When the barrel 1401 is loaded into the cleaning section 1403, an ultrasonic oscillator 1407 is started, and the barrel 1401 is rotated by a rotating means (not shown). When deaeration in the cleaning section 1403 is completed, the objects 1402 are loaded into a rinsing section 1404 filled with distilled water containing a rust preventive via the lifting mechanism 1412. In this case as well, the rinsing section 1404 is deaerated in advance by a second deaerating section 1410. When the barrel 1401 is loaded into the rinsing section 1404, the rinsing section 1404 operates in the same manner as the cleaning section 1403. Subsequently, the objects 1402 are cleaned with hot water in a hot-water cleaning section 1405, and dried by a hot air blower 1408 in a drying section 1406. Thereafter, the objects 1402 are conveyed in a storing section.

The states of objects before and after degreasing processes in such conventional techniques will be compared by using graphs. FIG. 12 shows the absorbance of fats and oils adhering to objects to be processed before a degreasing process in a conventional apparatus using no ultrasonic waves. This absorbance is based on C—H (carbon-hydrogen) stretching vibration in infrared spectrophotometry. FIG. 13 shows the absorbance of fats and oils before a degreasing process in a combination of conventional techniques, such as the one shown in FIG. 11, i.e., a degreasing apparatus which uses an ultrasonic oscillator having an deaerating unit and has a barrel swinging means in addition to a barrel rotating means. FIG. 14 shows the absorbance of fats and oils adhering to the objects after a degreasing process in the case shown in FIG. 12. The absorbance in FIG. 14 decreases to about 42% (0.0710/0.1664) of that in FIG. 12. FIG. 15 shows the absorbance of the fats and oils adhering to the objects after a degreasing process in the case shown in FIG. 13. The absorbance in FIG. 15 decreases to about 36% (0.0543/0.1479) of that in FIG. 13.

In the above conventional degreasing apparatuses using ultrasonic waves, each of techniques (1), (2), and (3) uses only some of the techniques of improving the degreasing efficiency by using ultrasonic waves. In addition, attention is only paid to the characteristics of ultrasonic waves which apply impacts on objects to be processed so as to physically degrease the objects, but no attention is paid to the temperature characteristics of fats and oils adhering to the surfaces of the objects. That is, the conventional apparatuses do not fully enhance the degreasing ability.

With regards to the techniques of hydro-extracting process solutions, technique (4) is not essentially a hydro-extraction method. In addition, as a hydro-extraction process is repeated, the concentration of a solution decreases. The amount of process solution increases or decreases unless the amount of solution carried away is equal to the amount of cleaning solution. Furthermore, with a decrease in the concentration of a process solution, the concentration of the main component in the process solution must be analyzed and tested, and the concentration of the solution must be adjusted. Along with these operations, the costs of chemicals and waste water treatment increase.

Technique (5) is designed to perform hydro-extraction by a free fall and increase the hydro-extraction amount by increasing the length of the time a barrel is held above a bath. There is a limit to hydro-extraction of a process solution impregnating between objects to be processed or between a barrel and objects to be processed while the barrel is at rest. That is, sufficient hydro-extraction cannot be expected.

The conventional apparatus described with reference to FIG. 11 uses water as a process solution, ultrasonic vibrations, deaeration, rotation of the barrel, and the like. That is, this apparatus is a degreasing apparatus which satisfies considerably ideal conditions. However, in the apparatus, since distilled water as a process solution is not heated, the viscosity of fats and oils on the surfaces of objects to be processed does not decrease, and perfect degreasing of the objects cannot be expected. In addition, hydro-extraction is not positively performed after a degreasing process in each bath.

SUMMARY OF THE INVENTION

It is an object of the present invention to provide an ultrasonic degreasing apparatus which enhances the degreasing capacity of the surfaces of objects to be processed by using ultrasonic waves.

It is another object of the present invention to provide an ultrasonic degreasing apparatus which can sufficiently hydro-extracts the surfaces of objects to be processed after a degreasing process.

In order to achieve the above objects, according to the present invention, there is provided an ultrasonic degreasing apparatus comprising a cleaning section, having first ultrasonic oscillation means for oscillating ultrasonic waves in first distilled water and first heater means for heating the first distilled water, for performing a degreasing process including a cleaning process with respect to an object to be processed in the first distilled water heated by the first heater means by using the ultrasonic waves oscillated by the first ultrasonic oscillation means, the cleaning section having first deaerating means for performing deaeration by circulating the first distilled water, a rinsing section, having second ultrasonic oscillation means for oscillating ultrasonic waves in second distilled water containing a rust preventive and second heater means for heating the second distilled water, for performing a degreasing process including a rinsing process with respect to the object, conveyed from the cleaning section, in the second distilled water heated by the second heater means by using the ultrasonic waves oscillated by the second ultrasonic oscillation means, the rinsing section having second deaerating means for performing deaeration by circulating the second distilled water, a hot-water cleaning section, having third heater means arranged in third distilled water to heat the third distilled water, for performing a cleaning process with hot water with respect to the object, conveyed from the rinsing section, in the third distilled water heated by the third heater means, and a drying section for drying the cleaned object conveyed from the hot-water cleaning section.

BRIEF DESCRIPTION OF THE DRAWINGS

FIGS. 2A to 2C are views showing the main part of the apparatus in FIG. 1, in which FIG. 2A is a perspective view showing a barrel holding arm, FIG. 2B is a perspective view showing a barrel, and FIG. 2C is a view showing the arrangements of barrel rotating and swinging sections;

FIGS. 3A to 3D are views showing a hydro-extracting operation in the apparatus in FIG. 1, in which FIGS. 3A and 3B are front and side views showing the barrel stopped at an upper position, FIG. 3C is a front view showing the barrel in an inclined state, and FIG. 3D is a sectional view showing a state wherein compressed air is blown into the barrel;

FIGS. 5A and 5B are views showing an example of hydro-extraction in the apparatus in FIG. 4, in which FIG. 5A is a front view showing a cleaning section, and FIG. 5B is a sectional view showing the cleaning section;

DESCRIPTION OF THE PREFERRED EMBODIMENTS

The present invention will be described below with reference to the accompanying drawings.

Figure 1:
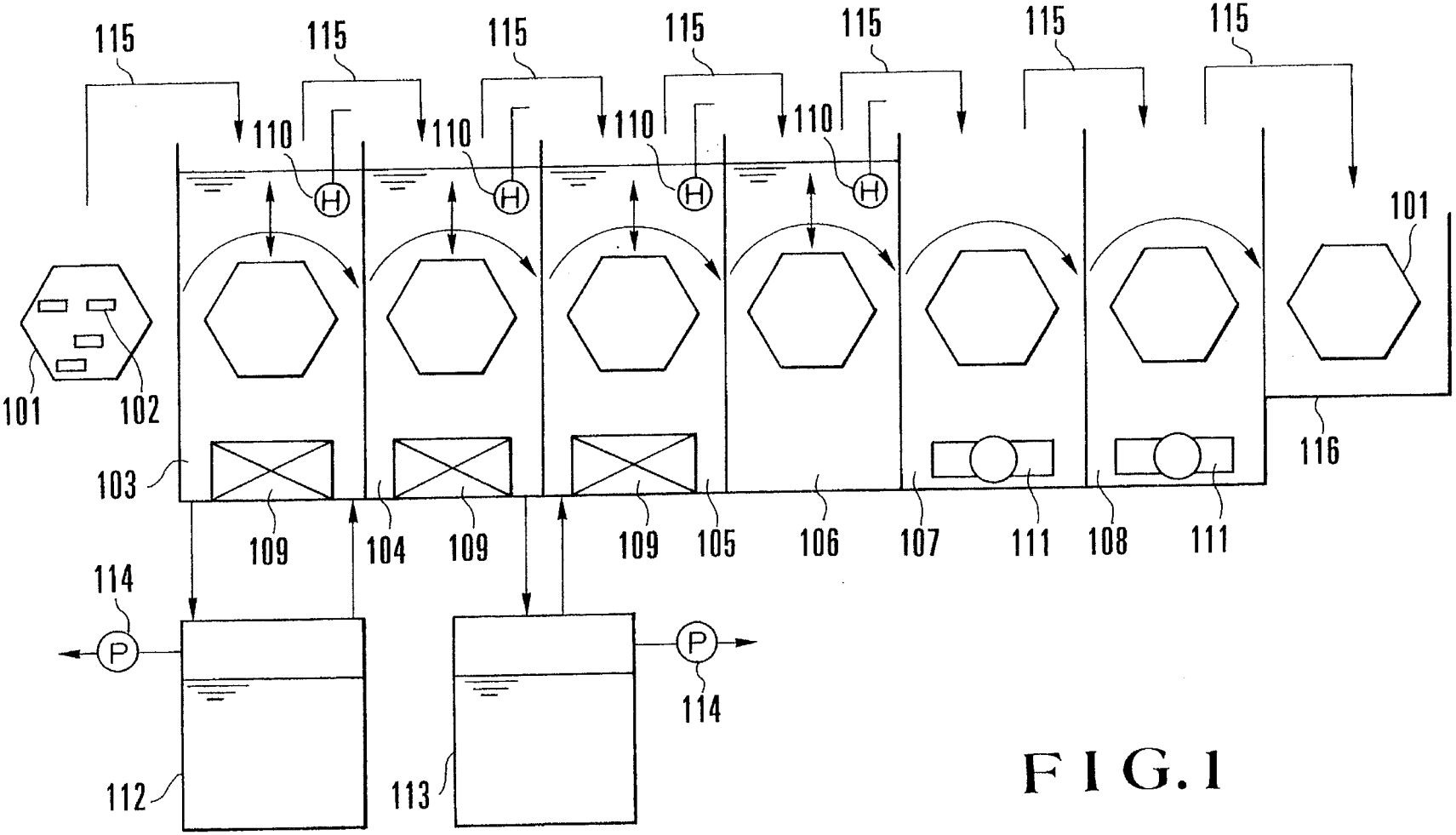
FIG. 1 is a block diagram showing the overall arrangement of an ultrasonic degreasing apparatus for processing bulk parts as objects to be processed according to the first embodiment of the present invention.
Figure 2A:
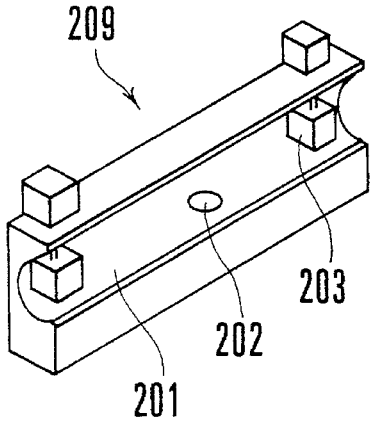
Figure 2B:
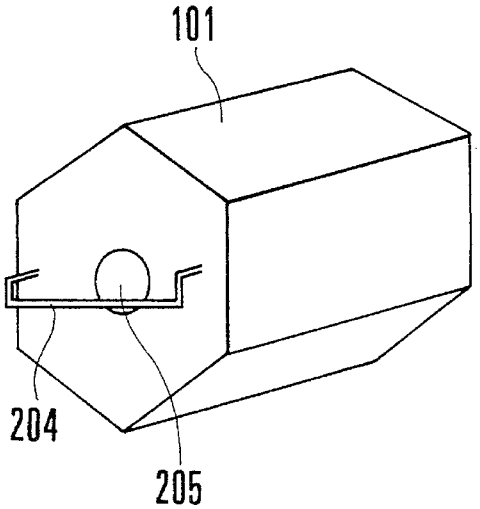
Figure 2C:
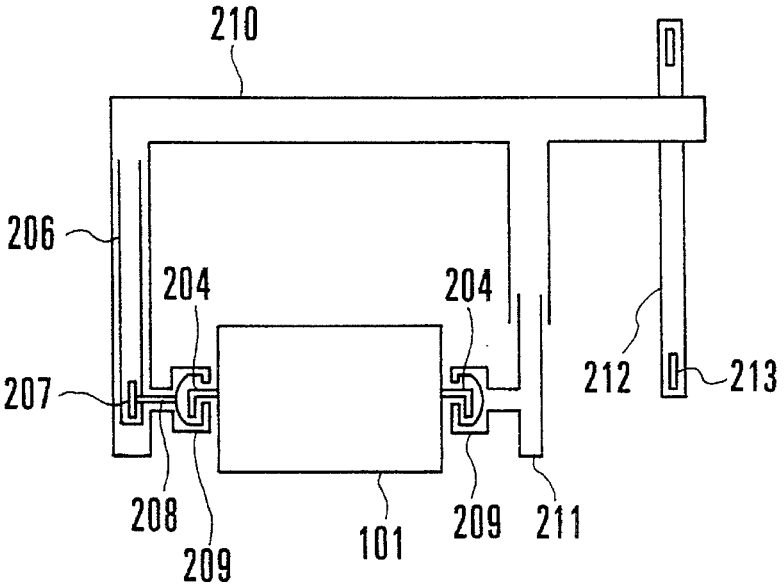
Figure 3A:
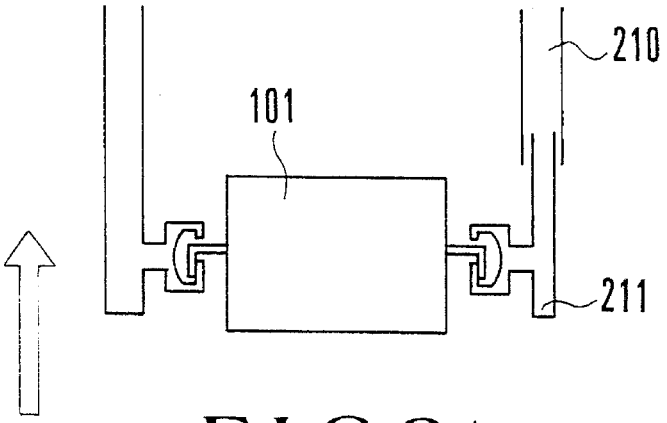
Figure 3B:
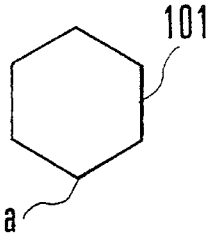
Figure 3C:
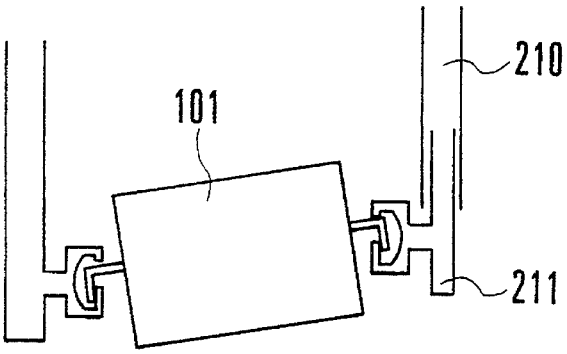
Figure 3D:
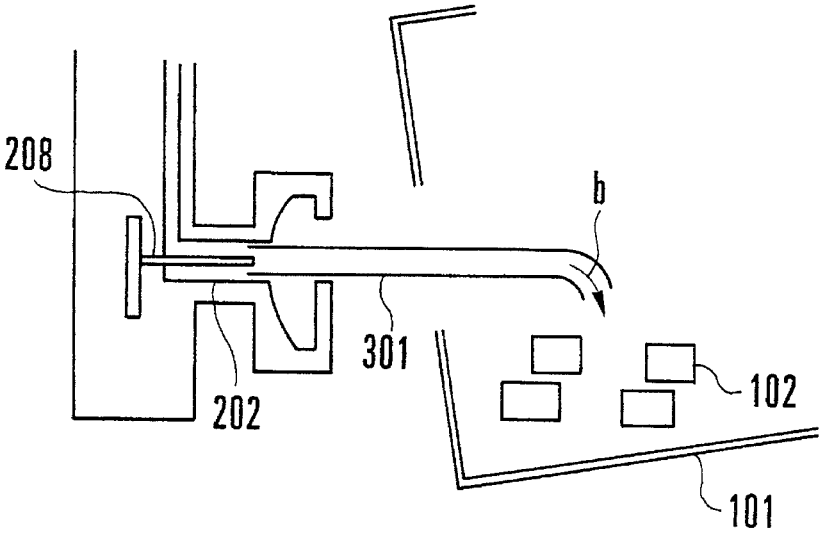

FIG. 1 shows the overall arrangement of a degreasing apparatus for processing bulk parts as objects to be processed according to the first embodiment of the present invention. FIGS. 2A to 2C show the main part of the apparatus in FIG. 1. FIG. 2A shows a barrel holding arm. FIG. 2B shows a barrel. FIG. 2C shows a barrel rotating section and a barrel swinging section. FIGS. 3A to 3D show a hydro-extracting operation of the first embodiment. FIGS. 3A and 3B show the barrel stopped at an upper position. FIG. 3C shows the barrel in an inclined state. FIG. 3D shows a state wherein compressed air is blown into the barrel.

Figure 4:
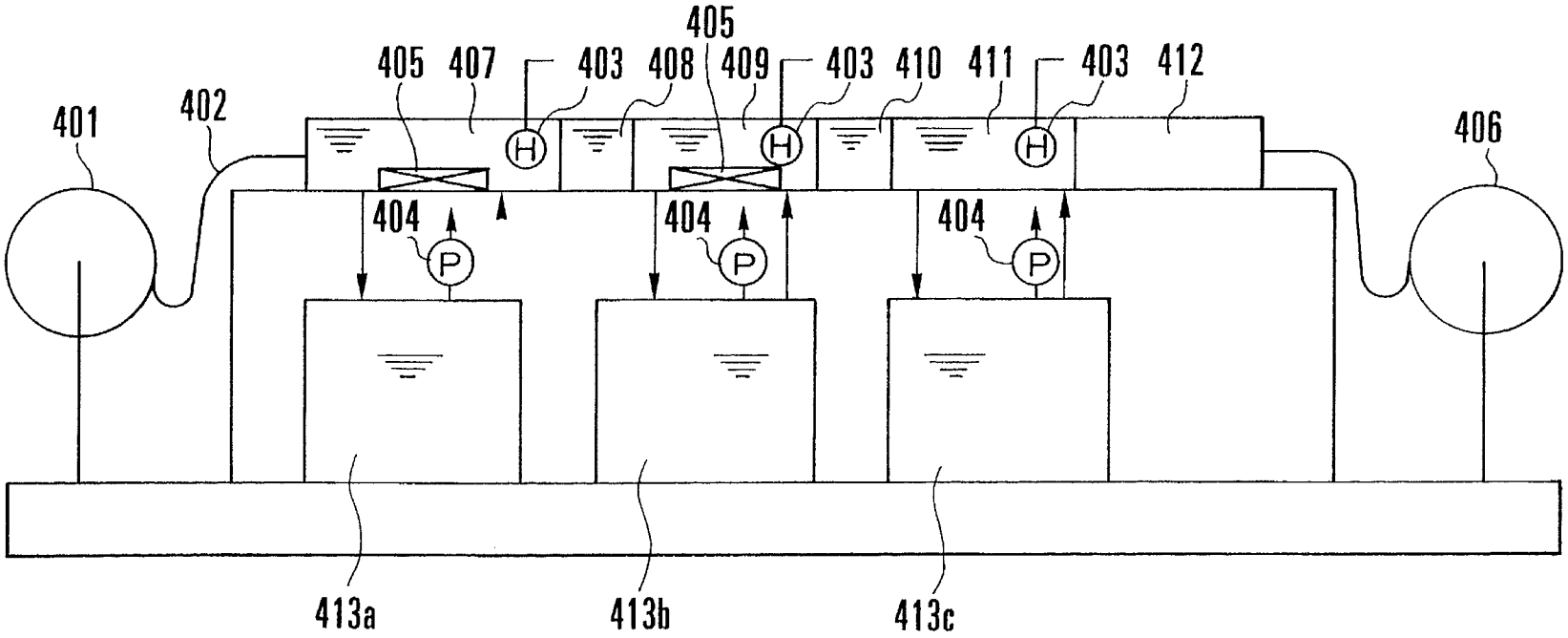
FIG. 4 is a block diagram showing the overall arrangement of an ultrasonic degreasing section for processing a hoop material as an object to be processed according to the second embodiment of the present invention.
Figure 5A:
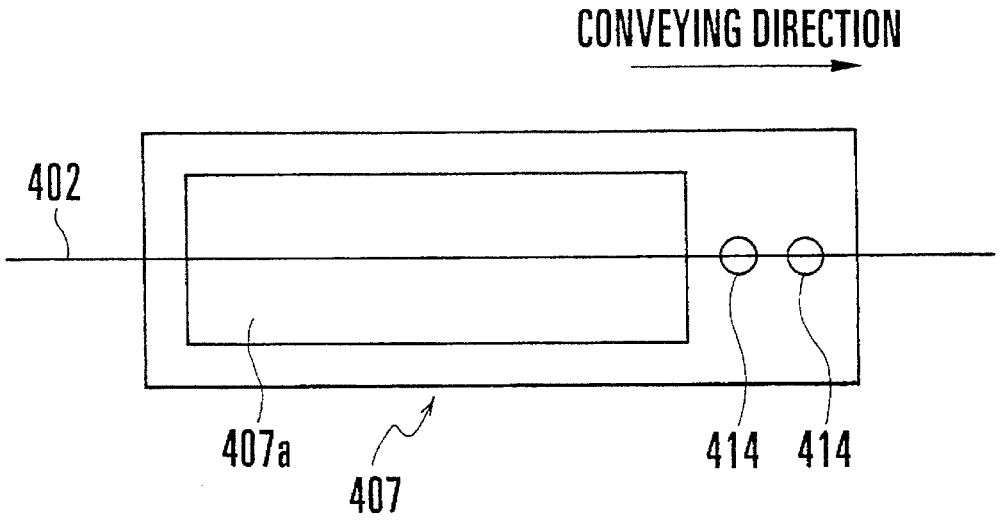
Figure 5B:
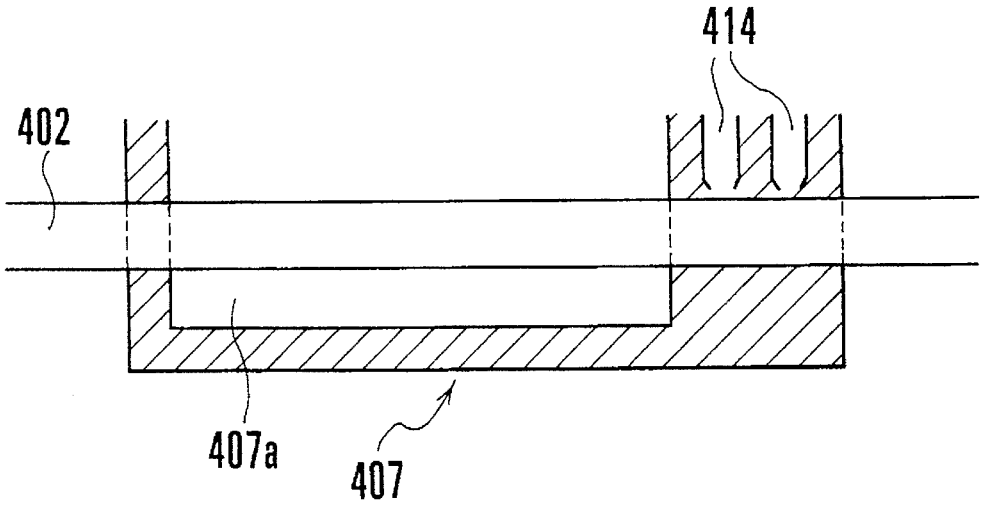

FIG. 4 shows the overall arrangement of a degreasing apparatus for processing a hoop material as an object to be processed according to the second embodiment of the present invention. FIGS. 5A and 5B show an example of hydro-extraction in the second embodiment. FIGS. 5A and 5B show a cleaning section.

FIGS. 6 to 9 are used to compare the results of the present invention. FIG. 10 shows general oil temperature-viscosity characteristics.

The apparatus of the first embodiment of the present invention, shown in FIG. 1, has the following basic arrangement.

A cleaning section 103, a first rinsing section 104, a second rinsing section 105, and a hot-water cleaning section 106 are sequentially arranged side by side. Each section uses distilled water as a process solution for degreasing and stores the distilled water in its bath. Ultrasonic oscillators 109 and heaters 110 are respectively arranged in the baths of the cleaning section 103 and the first and second rinsing sections 104 and 105. First and second deaerating sections 112 and 113 respectively having vacuum pumps 114 are connected to the cleaning section 103 and the first and second rinsing sections 104 and 105. Distilled water is circulating through the above sections. A heater 110 is arranged in the hot-water cleaning section 106. First and second drying sections 107 and 108 respectively having hot air blowers 111 are arranged following the hot-water cleaning section 106. Note that the distilled water stored in the first and second rinsing sections 104 and 105 contains a rust preventive.

In this arrangement, objects to be processed are degreased by sequentially dipping them in the baths of the cleaning section 103 to the second drying section 108. In the first embodiment, bulk parts are used as objects 102 to be processed, and these bulk parts are stored in a barrel 101. In order to sequentially load and dip this barrel 101 in the above baths, a lifting mechanism 115 as part of a convey unit (not shown) is arranged above the bath of each of the sections ranging from the cleaning section 103 to the second drying section 108.

Each lifting mechanism 115 includes a mechanism for rotating the barrel 101 in a corresponding bath, a mechanism for swinging the barrel 101 in the vertical direction, and a mechanism for hydro-extracting a residual process solution left in the barrel 101 and on the objects 102 while the barrel 101 is vertically moved.

The operation of the first embodiment having the above arrangement will be described below.

First of all, the barrel 101 containing the objects 102 is loaded into the cleaning section 103 by the lifting mechanism 115. The cleaning section 103 is deaerated in advance in the first deaerating section 112 using the vacuum pump 114 so as to improve the propagation characteristics of the ultrasonic oscillator 109. In addition, distilled water as a process solution is heated to 60° to 70° C. by the heater 110 in advance. FIG. 10 shows the relationship between the oil viscosity and the oil temperature. As shown in FIG. 10, it is known that as the oil temperature increases, the viscosity decreases. When the barrel 101 is loaded into the cleaning section 103, the ultrasonic oscillator 109 starts to operate, and the barrel 101 starts to swing in the vertical direction while rotating. Degreasing of the oil adhering to the surfaces of the objects 102 progresses owing to the synergistic effect of the respective factors, i.e., a decrease in the viscosity of the oil on the surfaces of the objects 102 with an increase in the temperature of the distilled water, as shown in FIG. 10, physical impacts produced by ultrasonic waves upon improvement of the propagation characteristics by deaeration, and the rotating and swinging motions of the barrel 101.

When the degreasing process is completed, the barrel 101 is raised by the lifting mechanism 115, and hydro-extraction (the arrangement and operation for hydro-extraction will be described in detail later) of the residual solution in the barrel 101 and on the objects 102 is started. Subsequently, the barrel 101 is loaded into the first rinsing section 104. The first rinsing section 104 is also deaerated in advance in the second deaerating section 113, and the distilled water is also heated to 60° to 70° C. by the heater 110 in advance. When the barrel 101 is loaded into the first rinsing section 104, the respective factors act in the same manner as in the cleaning section 103, thereby performing a degreasing process. The barrel 101 is then loaded into the second rinsing section 105. The state and operation conditions of the second rinsing section 105 are the same as those of the first rinsing section 104. The barrel 101 is cleaned with hot water by the hot-water cleaning section 106 heated to about 60° C. in advance. Thereafter, the barrel 101 is dried by the first and second drying sections 107 and 108, each of which blows hot air having a temperature of 200° to 250° C. by using the hot air blower 111. The barrel 101 is conveyed to a storing section 116 by the lifting mechanism 115.

An arrangement and operation associated with the rotating and swinging motions of the barrel 101 in the cleaning section 103, the first and second rinsing sections 104 and 105, and the hot-water cleaning section 106 will be described below. FIG. 2C shows the arrangement of a barrel rotating and swinging carrier. FIG. 2A shows a barrel holding arm 209. FIG. 2B shows the barrel 101. Barrel arms 204 mounted on both side surfaces of the barrel 101 are inserted in barrel arm guide sections 201 of the barrel holding arms 209. Each barrel arm 204 is locked by pawls 203 on the two ends of a corresponding barrel holding arm 209 to be fixed. When a shaft 208 is rotated by a driving motor (not shown) via a rotating chain 206 and a rotating gear 207, the barrel 101 is rotated via the barrel arm guide sections 201. The barrel 101 is swung in the vertical direction when an overall support arm 210 is vertically moved via a swing chain 212 and a swing gear 213 as in a pulley system. With these operations, the barrel 101 is rotated and swung simultaneously with the operation of the ultrasonic oscillator 109.

An arrangement and operation associated with hydro-extraction will be described next with reference to FIGS. 3A to 3D. After each of the following processes: a degreasing process, a rinsing process, and a cleaning process with hot water, i.e., at each of the following sections: the cleaning section 103, the first rinsing section 104, the second rinsing section 105, and the hot-water cleaning section 106 in FIG. 1, the barrel 101 is raised by the lifting mechanism 115 together with the support arm 210 and a carrier 211, as indicated by the arrow in FIG. 3A. As a result, the barrel 101 is set in the state shown in FIG. 3A. The barrel 101 is then rotated by the above driving motor by a predetermined number of rotations. The barrel 101 is stopped in the state shown in FIG. 3B, i.e., when one vertex a of hexagonal barrel 101 is located at a lower position in the vertical direction, and coarse hydro-extraction is performed. Subsequently, the arm of the carrier 211 contracts upon a motion based on gears (not shown) and a chain (not shown) as in a pulley system, and stops at the position in FIG. 3C, thereby inclining the barrel 101 in the axial direction. With this operation, hydro-extraction is further performed. In addition, as shown in FIG. 3D, compressed air b is blown against residual water and the objects 102 gathering at a lower portion of the barrel 101 after the process via an air spray port 202 and a flexible tube 301. At the same time, the barrel 101 in an inclined state is rotated again, thereby performing a final hydro-extraction process. Note that the compressed air b is blown from the right and left side surfaces of the barrel 101 at once, and the barrel 101 is rotated. Therefore, water adhering to the inner wall of the barrel 101 can also be hydro-extracted sufficiently.

In the above hydro-extraction method, hydro-extraction is performed by using three means, i.e., rotation of the barrel 101, inclination of the barrel 101, and blowing of compress air into the barrel 101. However, hydro-extraction may be performed by using one means or a combination of two means of the above three means depending on the situation.

In the first embodiment, two pairs of stages of rinsing and drying sections are arranged as the first and second rinsing sections 104 and 105 and the first and second drying sections 107 and 108 so as to obtain a high degreasing ability with respect to any types of objects to be processed. However, only one pair of stages of rinsing and drying sections may be arranged in accordance with the types, shapes, and quantity of objects to be process, as long as a sufficient degreasing ability can be obtained.

In comparison with the prior arts, the present invention has the following characteristics features:

① A heating means (heater) for decreasing the viscosity of an oil is arranged for each bath (so that temperature control can be performed in accordance with the viscosity of the oil). In this case, the oil is a machine oil or the like adhering to objects to be processed.

② In order to improve the efficiency of ultrasonic waves, a barrel rotating mechanism, a barrel swinging mechanism, and a deaerating unit are arranged for each bath.

③ In order to make the concentration of a cleaning solution uniform in each bath, the barrel is rotated and inclined.

④ Hydro-extraction air is blown after each of the following processes: a cleaning process, a rinsing process, and a cleaning process with hot water.

As shown in FIG. 4, in a degreasing apparatus for processing a hoop material according to the second embodiment of the present invention, a cleaning section 407, a water cleaning section 408, a rinsing section 409, a water cleaning section 410, a hot-water cleaning section 411, and a drying section 412 are basically arranged in the order named. A hoop supply section 401 is arranged in front of the cleaning section 407, and a hoop storing section 406 is arranged behind the drying section 412. The cleaning section 407 and the rinsing section 409 respectively have ultrasonic oscillators 405 arranged therein. Deaerating sections 413*a* to 413*c*, each comprising a heater 403 and a vacuum pump 404, are respectively connected to the cleaning section 407, the rinsing section 409, and the hot-water cleaning section 411. A process solution circulates through these sections. Note that distilled water is used as a process solution in each section, similar to the first embodiment.

A hoop-like object 402 to be processed is taken out from the hoop supply section 401 and caused to go through the respective baths, from the cleaning section 407 to the drying section 412 which are deaerated in the deaerating sections 413*a* to 413*c* in advance. With this operation, the object 402 undergoes a degreasing process using ultrasonic waves and a rinsing process using distilled water containing a rust preventive. Thereafter, the object 402 is cleaned with hot water and dried. The resulting object 402 is stored in the hoop storing section 406.

After each of the processes in the cleaning section 407 to the hot-water cleaning section 411, hydro-extraction of the object 402 is performed. FIGS. 5A and 5B show an example of hydro-extraction in the cleaning section 407. Hydro-extraction processes in other processing sections are performed in the same manner. Referring to FIGS. 5A and 5B, in the cleaning section 407, an intra-cleaning-section cell 407*a* and a few air spray ports 414 constituted by flexible tubes and serving as a hydro-extracting section are arranged in the conveying direction of the object 402. After the object 402 passes through the intra-cleaning-section cell 407*a*, the object 402 is hydro-extracted by compressed air blown upward from the air spray ports 414 in the vertical direction.

Figure 6:
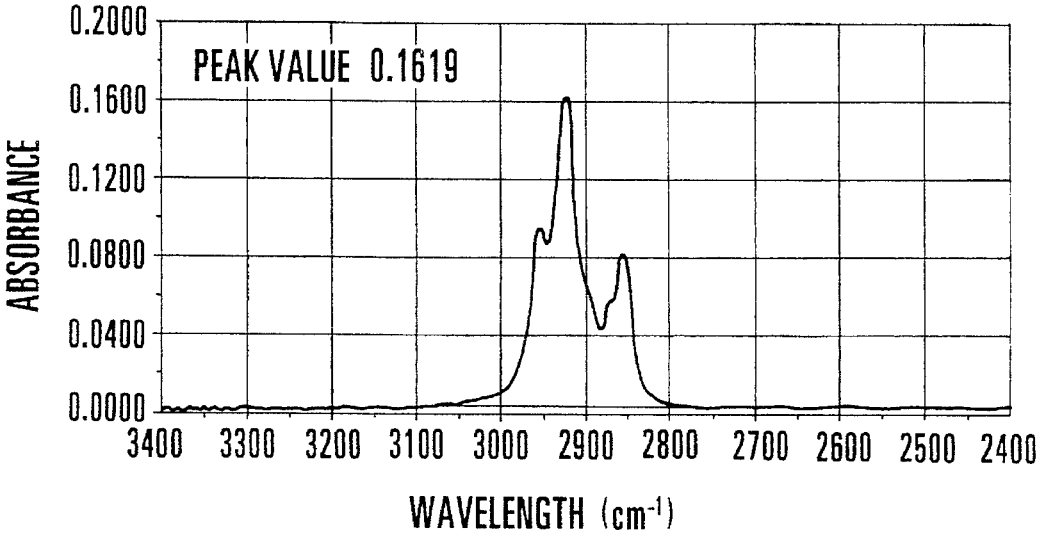
FIG. 6 is a graph showing the absorbance of fats and oils adhering to an object to be processed before a degreasing process, which is based on C—H (carbon-hydrogen) stretching vibration in infrared spectrophotometry, according to the first embodiment of the present invention.
Figure 7:
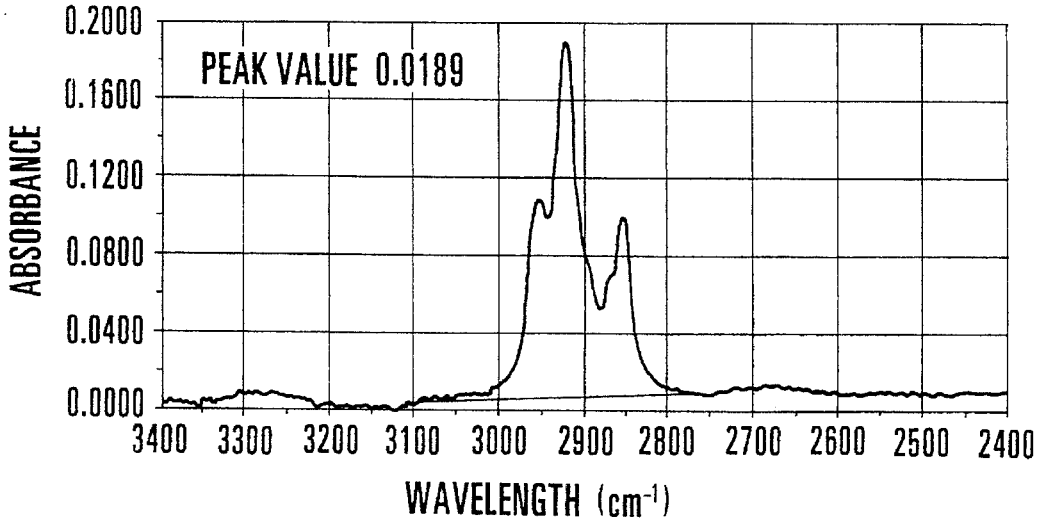
FIG. 7 is a graph showing the absorbance of fats and oils adhering to the object after a degreasing process.
Figure 8:
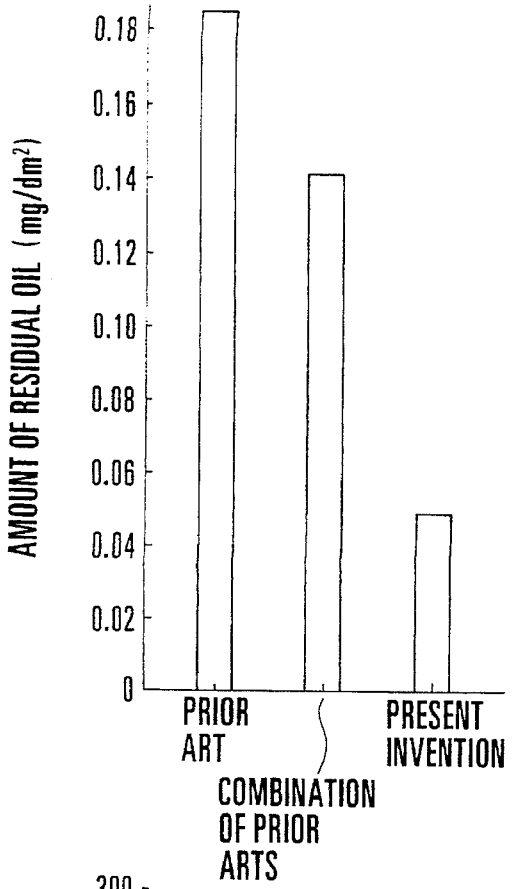
FIG. 8 is a graph showing the amount of residual fats and oils adhering to the object after the degreasing process in the first embodiment of the present invention in comparison with the prior art.
Figure 14:
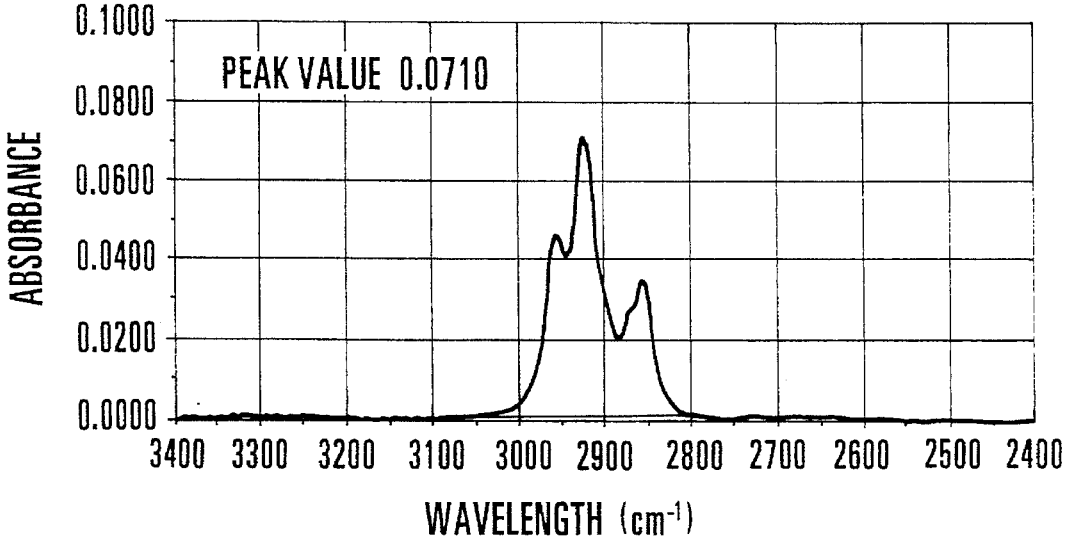
FIG.14 PRIOR ART
FIG. 14 is a graph showing the absorbance of fats and oils adhering to the object after a degreasing process in the case shown in FIG. 12.
Figure 15:
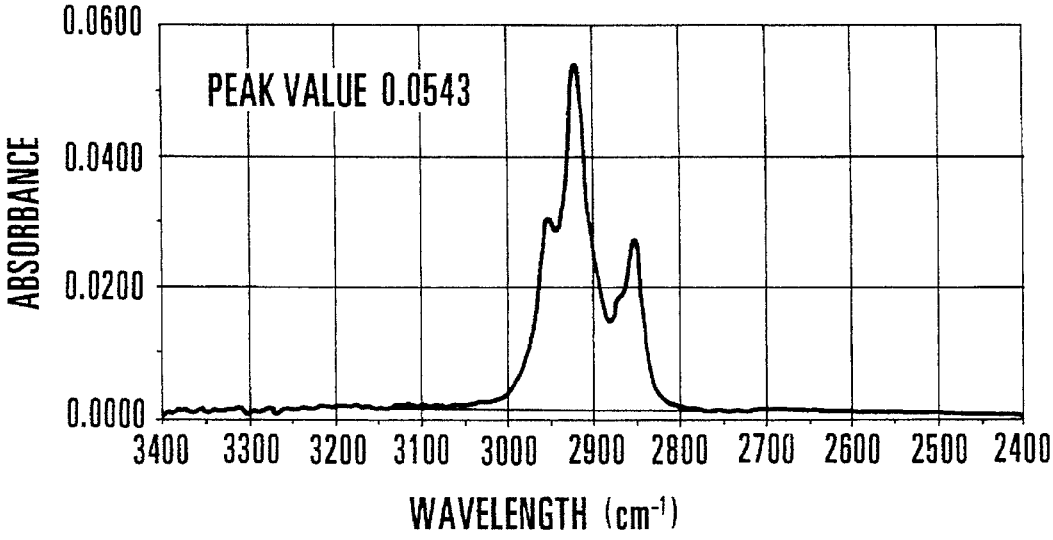
FIG.15 PRIOR ART
FIG. 15 is a graph showing the absorbance of fats and oils adhering to the object after a degreasing process in the case shown in FIG. 13.

The effect of the first embodiment of the present invention is represented by the amount of residual fats and oils and the amount of residual water after a degreasing process. FIGS. 6 and 7 show the absorbance of fats and oils adhering to an object to be processed before and after a degreasing process. FIG. 8 shows the amounts of residual fats and oils as amounts corresponding to the absorbance shown in FIG. 7 and FIGS. 14 and 15 associated with the prior arts. According to the results shown in FIGS. 6 and 7, in this embodiment, the absorbance after the degreasing process decreases to 12% or less (0.0189/0.1619) of that before the degreasing process. As shown in FIG. 8, it is, therefore, apparent that fats and oils are sufficiently removed as compared with the prior art (FIG. 14) and the combination of the prior arts (FIG. 15). That is, when the viscosity of fats and oils is decreased by increasing the temperature of a solution, the effect of a physical degreasing process using ultrasonic waves can be greatly improved.

Figure 9:
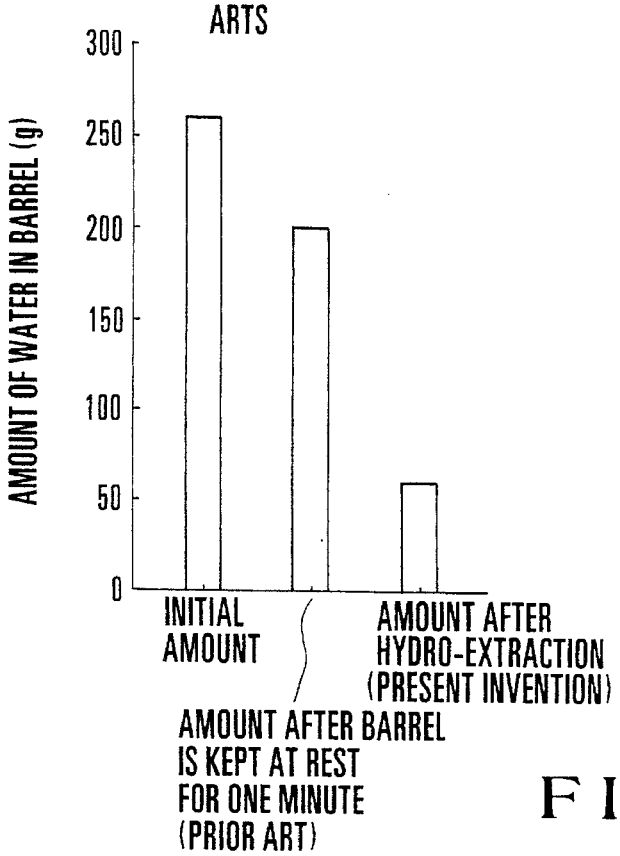
FIG. 9 is a graph showing the amount of residual water in the barrel and on objects to be processed in the first embodiment of the present invention in comparison with the prior art.
Figure 10:
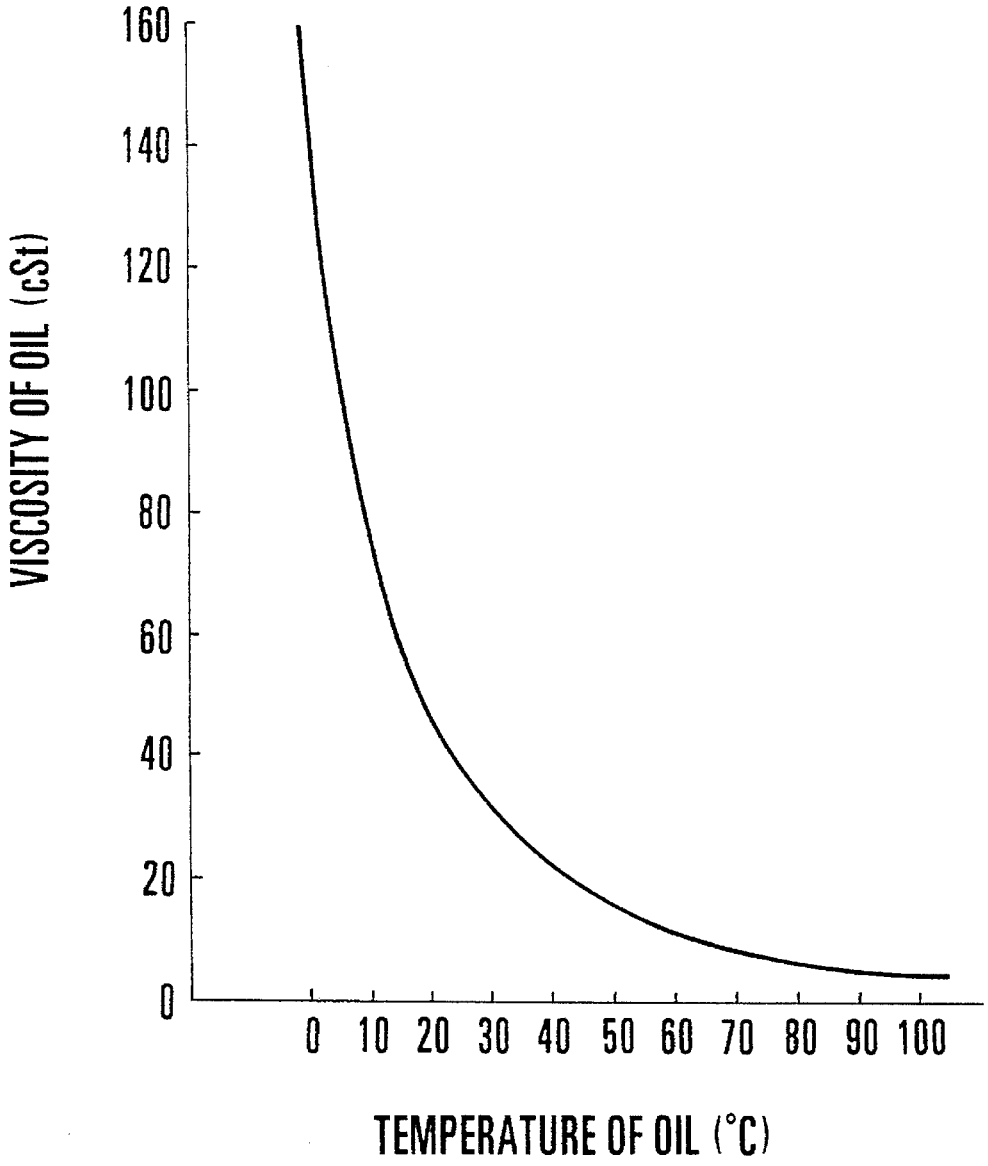
FIG. 10 is a graph showing the general temperature-viscosity characteristics of fats and oils.
Figure 11:
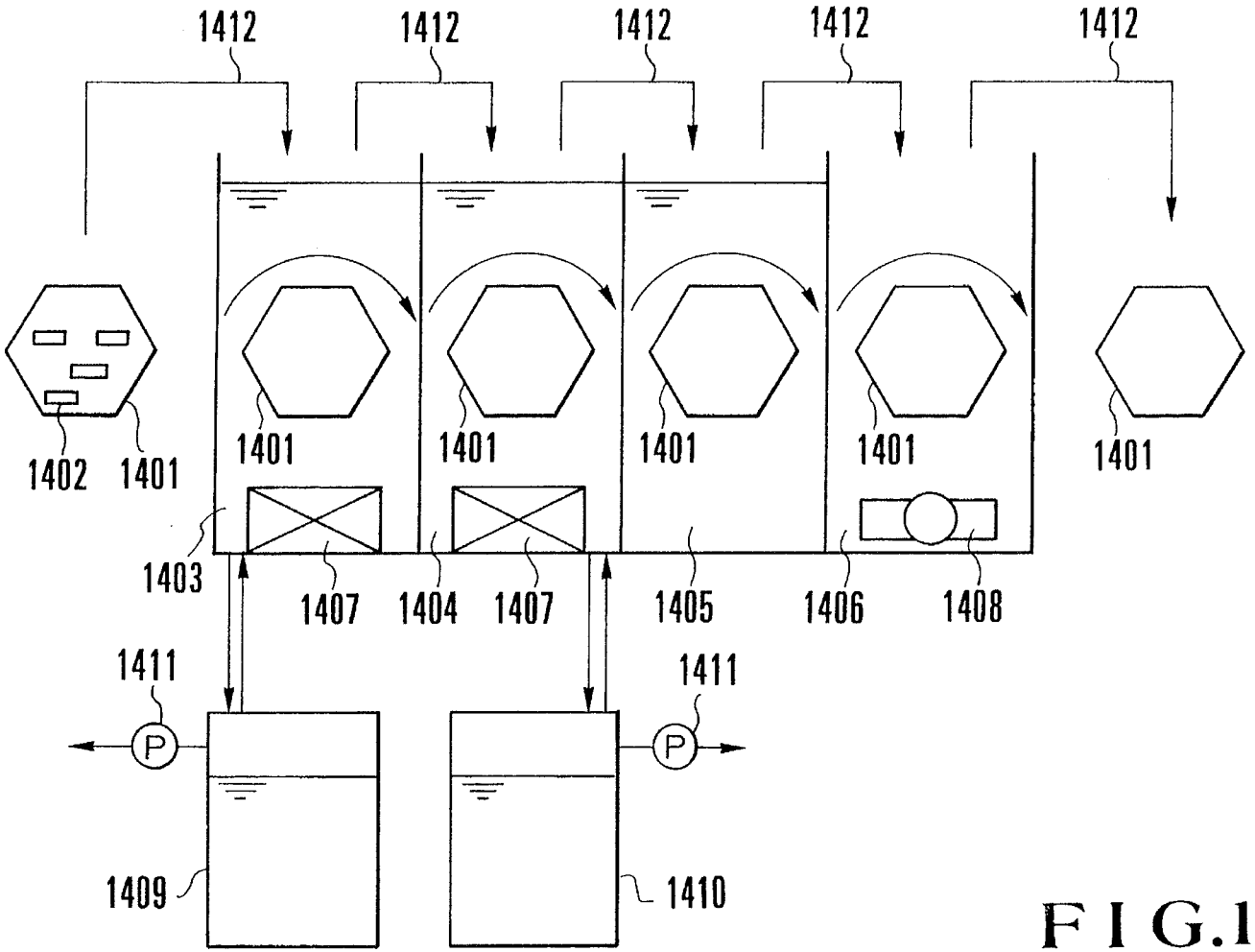
FIG.11 PRIOR ART
FIG. 11 is a block diagram showing the overall arrangement of a conventional ultrasonic degreasing apparatus using water as a process solution.
Figure 12:
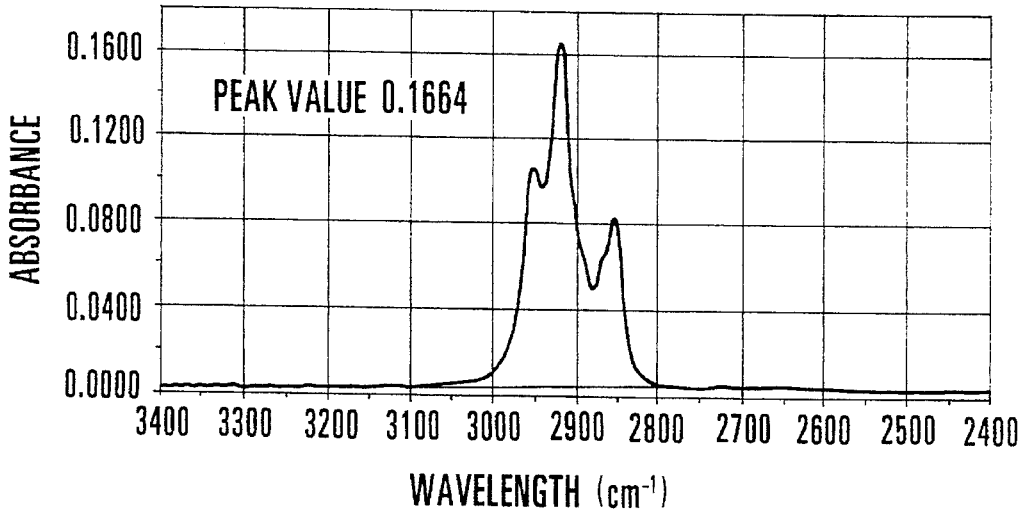
FIG.12 PRIOR ART
FIG. 12 is a graph showing the absorbance of fats and oils adhering to an object to be processed before a degreasing operation in a conventional apparatus using no ultrasonic waves.
Figure 13:
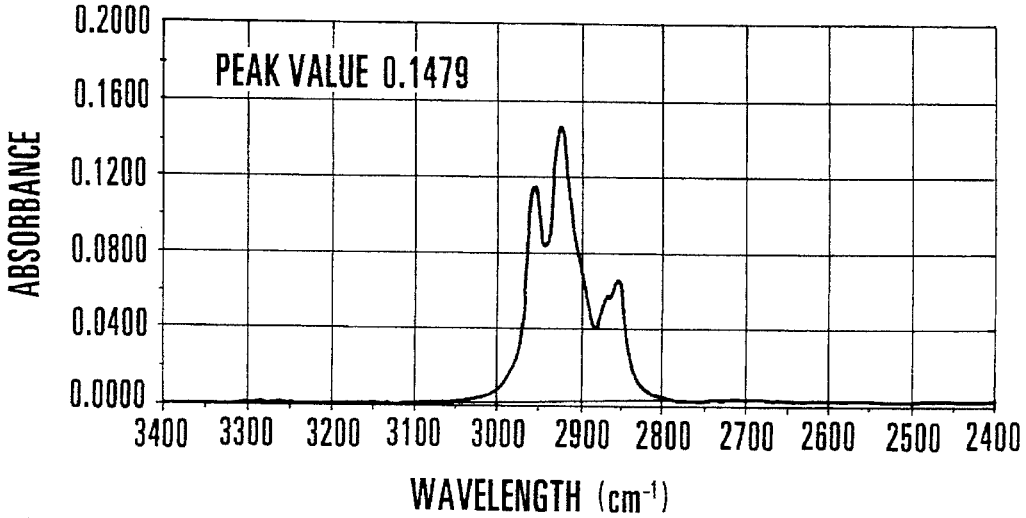
FIG.13 PRIOR ART
FIG. 13 is a graph showing the absorbance of fats and oils adhering to an object to be processed before a degreasing process in an apparatus obtained by combining prior arts.

FIG. 9 shows the amounts of residual water in the barrels and on objects to be processed after hydro-extraction. About 10,000 (4 kg) bulk parts were stored in a barrel having a weight of 4 kg and processed. After the process, the barrel was raised and stopped for five seconds. The weight of the barrel was then measured, and the increase was considered as the initial amount of water. Referring to FIG. 9, the amount of water measured after the barrel is raised and stopped for one minute is shown as that of the prior art. When this prior art is compared with hydro-extraction by the novel hydro-extracting means proposed in the present invention, it is found that sufficient hydro-extraction is performed in the present invention.

As is apparent, in the second embodiment, remarkable degreasing and hydro-extracting effects can be obtained as in the first embodiment.

As has been described above, distilled water is used as a process solution for degreasing, and ultrasonic waves are effectively used. In addition, in consideration of the temperature-viscosity characteristics of fats and oils, the distilled water is heated. With these operations, the fats and oils can be sufficiently removed. In addition, with the use of barrel rotating and swinging operations, the degreasing ability can be further improved. More specifically, as indicated by the above data, a degreasing ability at least three times higher than that of the prior arts can be obtained. Therefore, the yield of each of the subsequent processes, e.g., heat treatment, plating, and assembly, can be improved.

In addition, by performing hydro-extraction in each process bath, the amount of water or process solution carried away decreases. As a result, analysis of the concentration of the main component of the solution and adjustment, of the concentration of the solution, which are required when the concentration of the solution decreases, need not be performed. Furthermore, the costs of chemicals and waste water treatment can be greatly reduced.

What is claimed is:

1. An ultrasonic degreasing apparatus comprising:

a cleaning section, having first ultrasonic oscillation means for oscillating ultrasonic waves in first distilled water and first heater means for heating the first distilled water, for performing a degreasing process including a cleaning process with respect to an object to be processed in the first distilled water heated by said first heater means by using the ultrasonic waves oscillated by said first ultrasonic oscillation means, said cleaning section having first deaerating means for performing deaeration by circulating the first distilled water;

a rinsing section, having second ultrasonic oscillation means for oscillating ultrasonic waves in second distilled water containing a rust preventive and second heater means for heating the second distilled water, for performing a degreasing process including a rinsing process with respect to the object, conveyed from said cleaning section, in the second distilled water heated by said second heater means by using the ultrasonic waves oscillated by said second ultrasonic oscillation means, said rinsing section having second deaerating means for performing deaeration by circulating the second distilled water;

a hot-water cleaning section, having third heater means arranged in third distilled water to heat the third distilled water, for performing a cleaning process with hot water with respect to the object, conveyed from said rinsing section, in the third distilled water heated by said third heater means; and a drying section for drying the cleaned object conveyed from said hot-water cleaning section.

2. An apparatus according to claim 1, further comprising a porous barrel for storing the object constituted by a bulk part, and lifting means for vertically moving said barrel while sequentially conveying said barrel to said cleaning section, said rinsing section, said hot-water cleaning section, and said drying section.

3. An apparatus according to claim 2, further comprising rotating/driving means for rotating said barrel lowered into said cleaning section, said rinsing section, and said hot-water cleaning section, and swinging means for swinging said barrel lowered into said cleaning section, said rinsing section, and said hot-water cleaning section.

4. An apparatus according to claim 2, further comprising hydro-extracting means, arranged in said lifting means, for hydro-extracting a surface of the bulk part in said barrel when said barrel is raised from said cleaning section, said rinsing section, and said hot-water cleaning section.

5. An apparatus according to claim 4, wherein said hydro-extracting means comprises a rotating mechanism for rotating said barrel by a predetermined number of rotations.

6. An apparatus according to claim 4, wherein said hydro-extracting means comprises an inclining mechanism for vertically moving one end of said barrel to incline said barrel with respect to a horizontal plane.

7. An apparatus according to claim 4, wherein said hydro-extracting means comprises an air blowing mechanism for injecting/blowing compressed air into said barrel.

8. An apparatus according to claim 4, wherein said hydro-extracting means comprises a rotating mechanism for rotating said barrel by a predetermined number of rotations, an inclining mechanism for vertically moving one end of said barrel to incline said barrel with respect to a horizontal plane, an air blowing mechanism for injecting/blowing compressed air into said barrel.

9. An apparatus according to claim 1, wherein the first distilled water to the third distilled water are respectively heated to 60° to 70° C. by said first to third heater means.

10. An apparatus according to claim 1, wherein said rinsing section comprises a pair of cleaning baths which are filled with the second distilled water and to which the object is linearly conveyed, and said drying section comprises a pair of drying baths to which the object is linearly conveyed.

11. An apparatus according to claim 1, further comprising first and second water cleaning sections, respectively arranged between said cleaning section and said rinsing section and between said rinsing section and said hot-water cleaning section, for cleaning the object, constituted by a hoop material and conveyed from said cleaning section and said rinsing section, with water.

12. An apparatus according to claim 11, further comprising hydro-extracting means for performing hydro-extraction by blowing compressed air against the hoop material when the hoop material is conveyed from said cleaning section, said first water cleaning section, said rinsing section, said second water cleaning section, and said hot-water cleaning section.

* * * * *